US005672114A

United States Patent [19]

Tu

[11] Patent Number: 5,672,114

[45] Date of Patent: Sep. 30, 1997

[54] GUIDING DEVICE FOR PUTTING PRACTICE

[75] Inventor: Wan-Chun Tu, Changhua City, Taiwan

[73] Assignee: Taitung Sports Goods Co., Changhua City, Taiwan

[21] Appl. No.: 762,860

[22] Filed: Dec. 10, 1996

[51] Int. Cl.[6] ..... A63B 69/36

[52] U.S. Cl. ..... 473/164; 473/166; 473/258; 473/172

[58] Field of Search ..... 473/257, 258, 473/259, 260, 265, 164, 166, 172

[56] References Cited

U.S. PATENT DOCUMENTS

| | | | |
|---|---|---|---|
| 1,545,648 | 7/1925 | Fletcher | 473/258 X |
| 4,368,888 | 1/1983 | Ren | 473/164 |
| 5,209,484 | 5/1993 | Randall | 473/265 |
| 5,595,543 | 1/1997 | Wolk | 473/265 X |

*Primary Examiner*—George J. Marlo
*Attorney, Agent, or Firm*—Bacon & Thomas

[57] ABSTRACT

A guiding device for putting practice having a base plate, a pad, a golf supporting plate, a cover member, two screw sleeves, a large bolt, a small bolt, an inverted U-shaped fending rod, and an engaging sleeve is disclosed. The base plate has left and right guiding frames, raising slightly at the rear section to form a guide way there-between for the golf club to pass therethrough. The golf supporting plate is formed by a grooved rail with two flanges sectionally tilting upwardly from both sides for the golf ball to roll thereon and on which the golf ball putted when touching the inverted U-shaped fending rod will bounce back automatically to the original position indicated by a triangular golf sign disposed on the base plate for another putting practice. In addition, by means of the large and small adjusting bolts, the golf supporting plate can be adjusted left or right, moving into a desirable position measured by scales to meet the need of different users.

1 Claim, 4 Drawing Sheets

GUIDING DEVICE FOR PUTTING PRACTICE

BACKGROUND OF THE INVENTION

The present invention relates to a guiding device for putting practice, especially to a putting device comprising a base plate having left and right guiding frames to define a guide way therebetween for putting and a golf supporting plate forming a grooved rail for the golf ball to roll thereon. In addition, the golf-supporting plate can be adjusted left or right by means of large and small adjusting bolts, locating at a desirable position by measuring scales; and by means of an inverted U-shaped fending rod, the golf ball putted will bounce back automatically for the convenience of repeated practice.

Conventionally, the way of putting practice is simply carried out by drawing a line on the ground and the outcome of putting is measured optically. Thus, it is more often than not quite a waste of time, because it not only cannot effectively train a player to improve the putting skill, but also become very inconvenient for the golf ball must be repeatedly picked up each time the club is swung.

SUMMARY OF THE PRESENT INVENTION

It is, therefore, the primary object of the present invention to provide a guiding device for putting practice having two guiding frames defining a guide way therebetween for the golf club to pass therethrough so as to effectively train a player to improve the putting skill; and a golf supporting plate forming a grooved rail for the golf ball to roll thereon and on which the golf ball tounching an inverted U-shaped fending rod will bounce back automatically to its original location for the convenience of repeated putting practice.

DETAILED DESCRIPTION OF THE PREFERRED EMBODIMENTS

Figure 1:
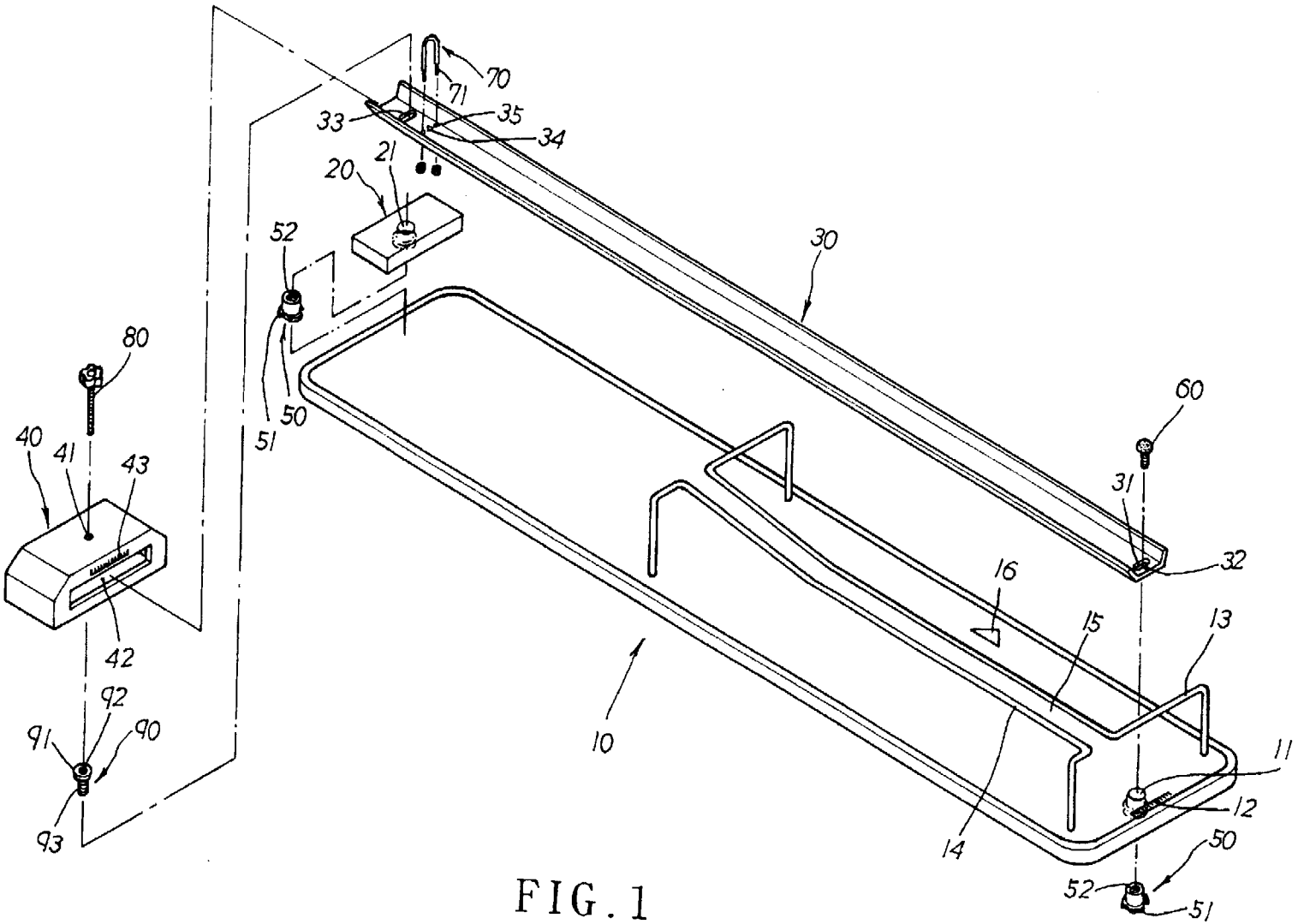
FIG. 1 is a perspective exploded view of the present invention.

The present invention relates to a guiding device for putting practice, comprising a base plate 10, a pad 20, a golf supporting plate 30, a cover member 40, two screw sleeves 50, a small adjusting bolt 60, an inverted U-shaped fending rod 70, a big adjusting bolt 80, and an engaging sleeve 90.

The base plate 10 is provided with a two-stage through hole 11 at the middle section of the front end thereof, and a measuring scale 12 having a scale mark defined thereon in front of the two-stage through hole at the top surface of the base plate thereof. In addition, a left and right guiding frames 13, 14 are disposed at the top front end of the base plate 10, raising slightly upwardly at the rear section to form a guide way 15 therebetween for a golf club to pass therethrough; and, a triangular golf sign 32 indicating the position of the golf ball placed is disposed at one side of the top front end of the base plate 10.

The pad 20 is provided with a two-stage through hole 21 at the middle section; while the golf ball supporting plate 30 forming a grooved rail with two flanges tilting sectionally upwardly at both sides is provided with first elongated oval slot 31 at the front end and second elongated oval slot 33 at the rear end. The first elongated oval slot 31 has a first triangular mark 32 disposed in front while the second elongated oval slot 33 has a second triangular mark 34 disposed in front thereof with two through holes 35 each disposed on one side of the second triangular mark 34.

The top middle section of the cover member 40 has round hole 41, and one lateral face of the cover member 40 has a transverse elongated slot 42 provided with a measuring scale 43 having a scale mark defined thereon above the slot 42 thereof. Each of the two screw sleeves 50 has an engaging flange 51 extended at the bottom and screw threads 52 defining the inner wall thereof. The inverted U-shaped fending rod 70 has two ends, each having minute threads 71 at the lower section. The engaging sleeve 90 having an abutting flange 91 extended at the top is provided with outer threads 92 at the peripheral surface and inner threads 93 at the interior wall thereof.

Figure 2:
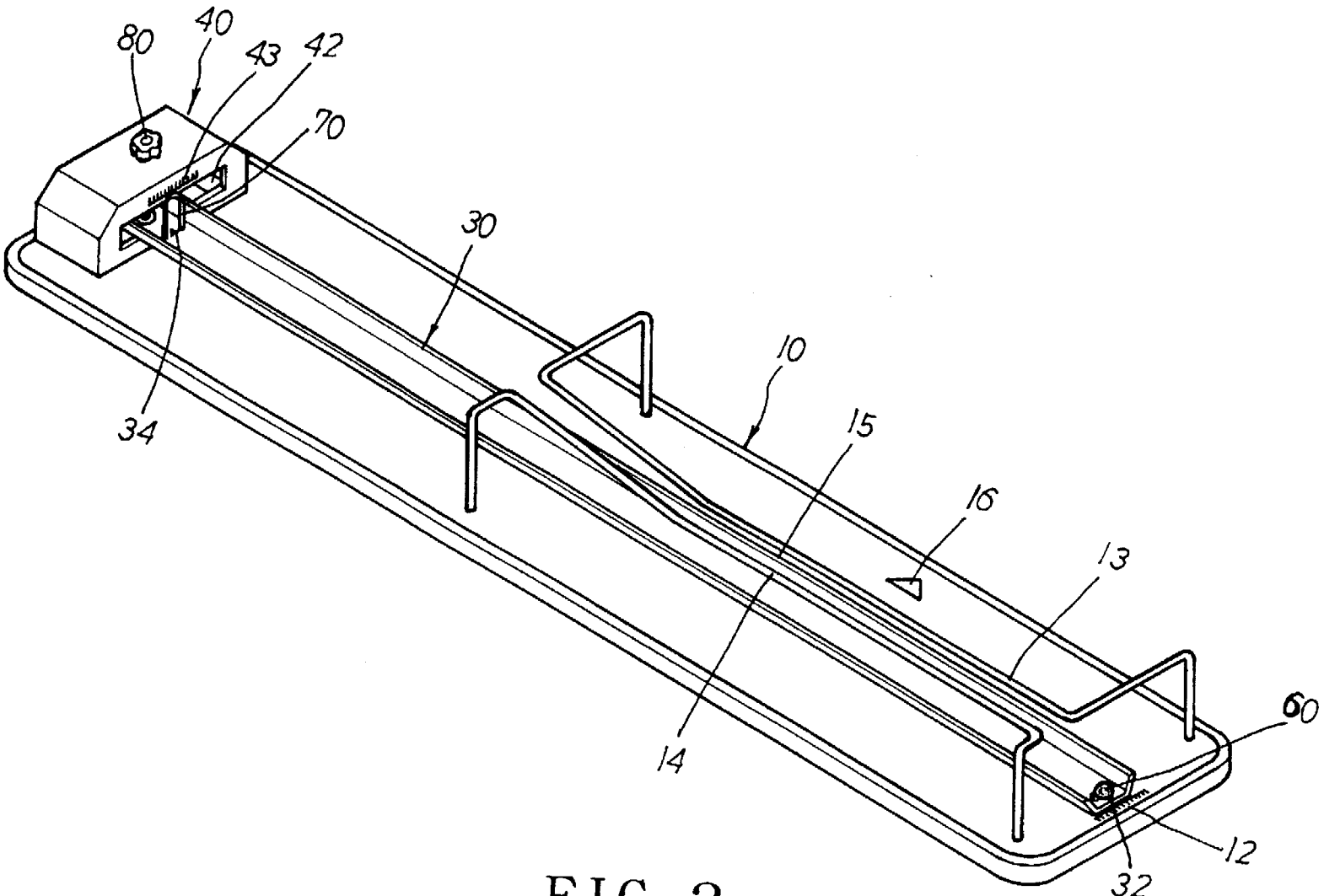
FIG. 2 is a perspective assembled view of the present invention.

Please refer to FIG. 2. In assembly, the two screw sleeves are upwardly joined to the two two-stage through holes disposed at the front end of the base plate 10 and the top middle section of the pad 20 respectively. The pad 20 is then properly located and fixedly secured at the top rear section of the base plate 10 by a fastening means. The inverted U-shaped fending rod 70 is engaged to the golf supporting plate 30 by passing both ends of the rod 70, each having minute threads 71, through the through holes 35 disposed at both sides of the triangular mark 34 an secured both ends 71 by two nuts. The large adjusting bolt 80, passing through the round hole 41 disposed at the middle section of the cover member 40 and applied with a fastening means at the lower section, is fixedly joined to the inner threads 93 disposed at the interior wall of the engaging sleeve 90. The small adjusting bolt 60, passing and abutting against the first elongated oval slot 31 disposed at the front end of the golf supporting plate 30, is screwed to the inner threads 52 of the screw sleeve 50 engaged with the two-stage through hole 11 of the base plate 10. The cover member 40 is located above the pad 20, with the rear end of the golf supporting plate 30 led through the transverse rectangular slot 42 disposed at one lateral surface of the cover member 40 and the engaging sleeve 90 passing and abutting against the second elongated oval slot 33 of the golf supporting plate 30 by the abutting flange 91, securing the cover member 40 to the pad 20 by engaging the outer threads 93 with the inner threads 52 of the screw sleeve 50 joined with the two-stage through hole 21 of the pad 20 thereof.

Figure 3A:
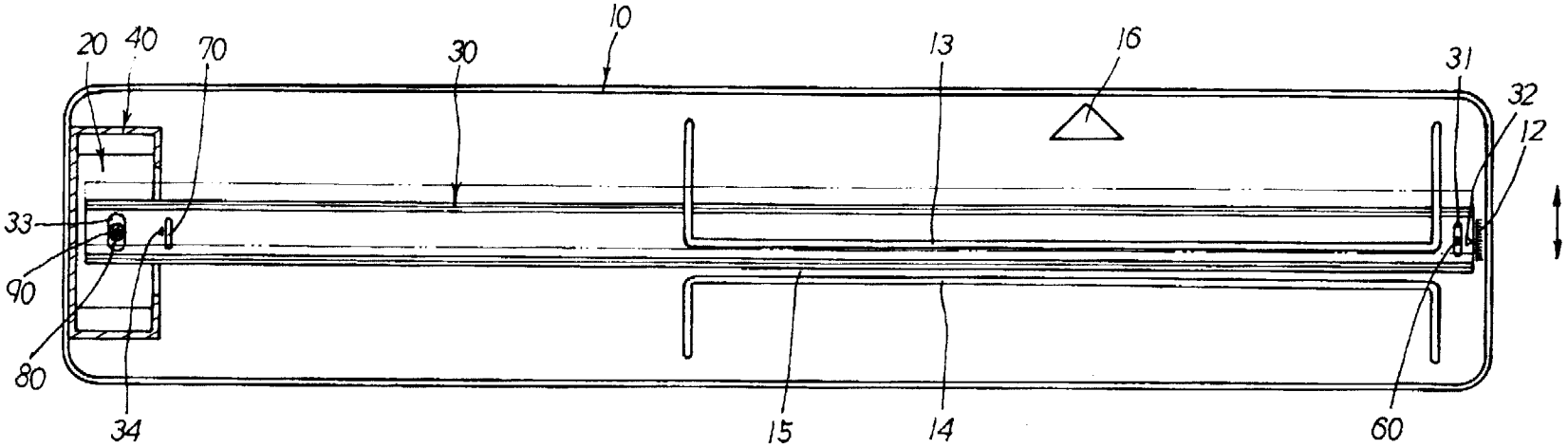
FIG. 3A is a top view of the present invention.
Figure 3B:
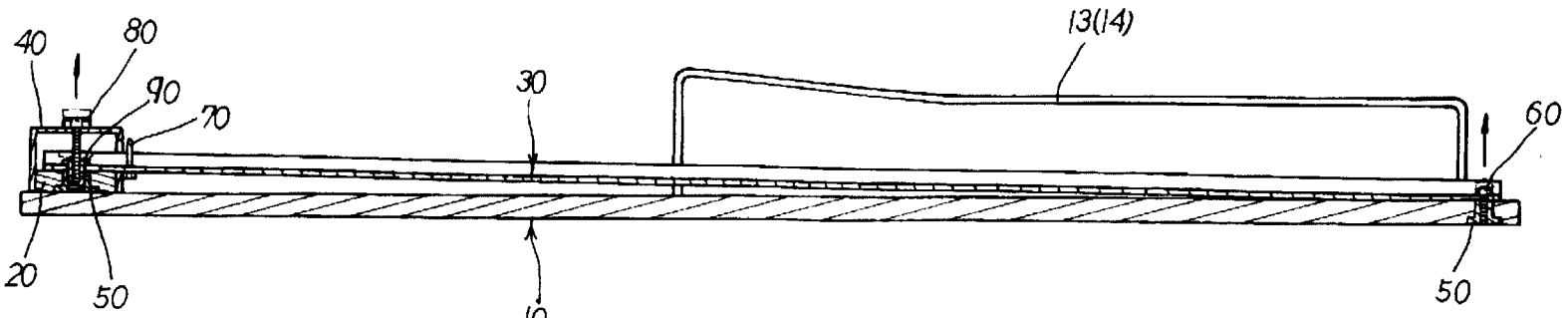
FIG. 3B is a sectional view thereof.

Please refer to FIG. 3. To practice putting, the golf ball 1 is located on the golf supporting plate 30 at a position marked by the triangular golf sign 16 disposed at the base plate 10. The golf club 2 is pushed and swung within the guide way 15 defined by the left and right guiding frames 13, 14, with the raising section of the guiding frames 13, 14 limiting and guiding the club 2 swung. When touching the inverted U-shaped fending rod 70, the golf ball will bounce back automatically to its original position for next putting practice.

Figure 4:
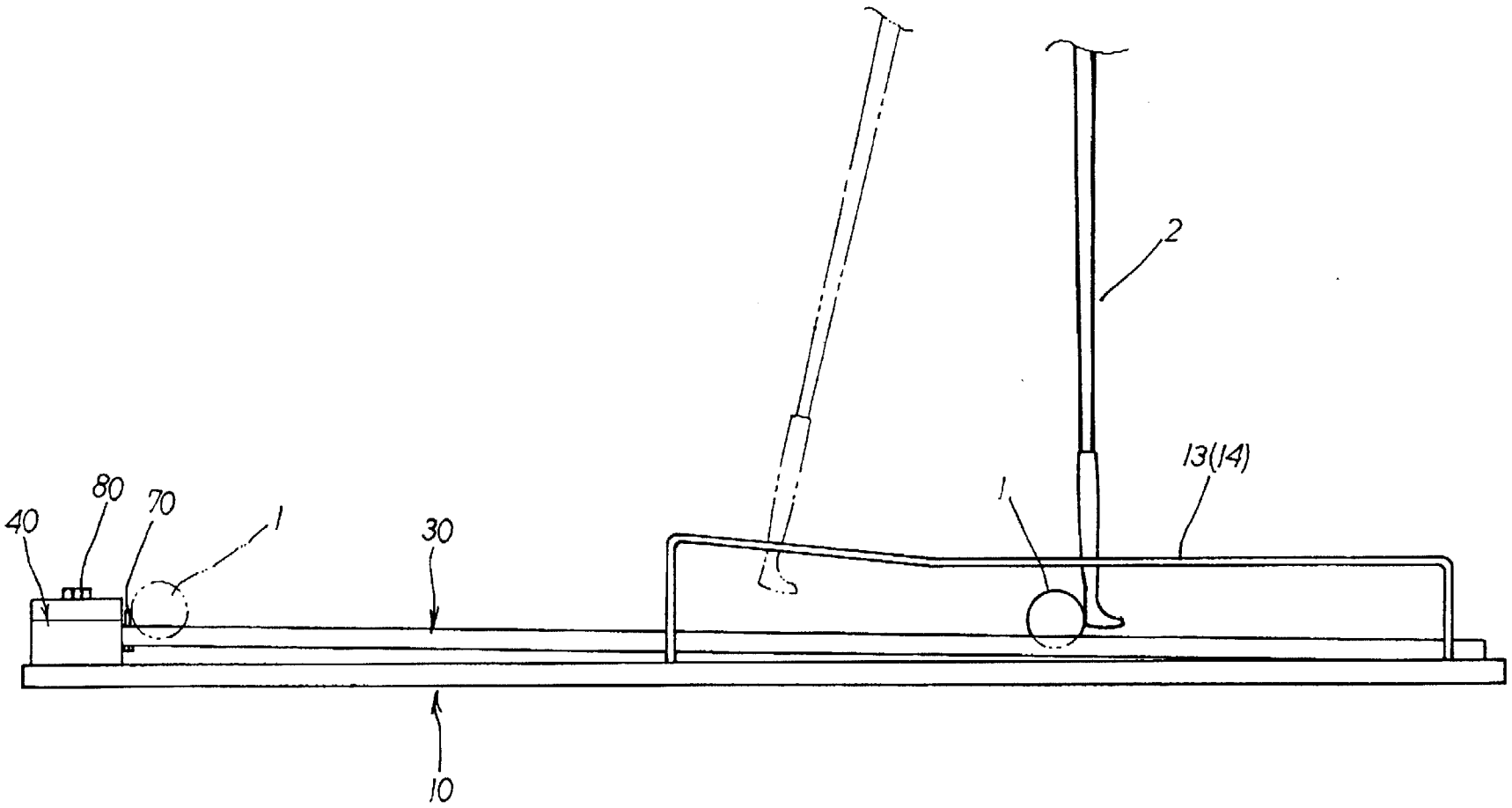
FIG. 4 is an operational view of the adjustment of the golf-supporting plate of the present invention.

Please refer to FIG. 4. The guiding device of the present invention can be adjusted to meet the need of different users. The large and small adjusting bolts 80, 60 can be loosened, released from abutting against the first and second elongated oval slots 31, 33 respectively. The golf supporting plate 30 can then be adjusted left or right in a scale according to the scale mark of the scales 43, 12 indicated by the triangular marks 32, 34 disposed on both ends of the golf supporting plate 30. When the golf supporting plate 30 is moved into a desirable position the large and small adjusing bolts 80, 60 is then screwed up, abutting against the first and second elongated oval slots 33, 32 again for the purpose of putting practice.

Thus, there are several advantages to the present invention. First, the guide way 15 can effectively train a player to improve the putting skill. Second, the golf supporting plate 30 can be adjusted in accordance with the user's need to boost the practical use of the device. The golf ball 1 putted will automatically bounce back to its original location for the convenience of repeated use.

What is claimed is:

1. A guiding device for putting practice, comprising a base plate, a pad, a golf ball supporting plate, a cover member, two screw sleeves, one small bolt, one large bolt, an inverted U-shaped fending rod, and an engaging sleeve wherein the base plate, having a two-stage through hole at the front end and a measuring scale with a scale mark defined thereon in front of the two-stage through hole, is provided with left and right guiding frames raising slightly upwardly at the rear section to form a guide way therebetween for the golf club to pass therethrough at the top front end and a triangular golf sign indicating the position of the golf ball at one side of the top front end thereof;

the pad has a two-stage through hole at the middle, section;

the golf ball supporting plate forming a grooved rail with two flanges tilting sectionally upwardly at both sides has first elongated oval slot with a first triangular mark disposed in front thereof at the front end and a second elongated oval slot with a second triangular mark disposed in front thereof and two through holes disposed at both sides of said mark at the rear end;

the cover member has a round hole at the top middle section and a transverse elongated slot at one lateral surface; the transverse elongated slot is provided with a measuring scale having a scale mark defined thereon above the slot thereof;

the inverted U-shaped fending rod has two ends, each provided with minute threads at the lower section;

the engaging sleeve has an abutting flange extended at the top, outer threads disposed at the peripheral surface, and inner threads disposed at the interior wall; while each of the screw sleeves has an engaging flange extended at the bottom and inner threads disposed at the interior wall;

whereby the two screw sleeves are engaged upwardly with the two two-stage through holes disposed at the front end of the base plate and the top middle section of the pad respectively; the pad is fixed by a fastening means at the rear end of the base plate; the inverted U-shaped fending rod is engaged with the golf ball supporting plate by passing both ends thereof through the through holes of the golf ball supporting plate and fixing both ends thereof by screws; the large adjusting bolt is adapted to pass the round hole of the cover member and is screwed to the engaging sleeve; the golf ball supporting plate is then led through the transverse elongated slot of the cover member and the engaging sleeve passed through the second elongated oval slot of the golf ball supporting plate with the abutting flange of the engaging sleeve abutting against the elongated oval slot and the outer thread of the engaging sleeve engaging with the inner threads of the screw sleeve engaged with the two-stage through hole of the pad; anal the small adjusting bolt is adapted to pass the first elongated oval slot, abutting at the top against the slot thereof and joining at the bottom to the inner threads of the screw sleeve engaged with the two-stage through hole of the base plate; whereby the device can effectively train a player to improve the putting skill with the golf ball bounced back automatically for repeated use, and the golf ball supporting plate can also be adjusted left or right to meet the need of different users.

* * * * *